US008671900B2

(12) United States Patent
Weber

(10) Patent No.: US 8,671,900 B2
(45) Date of Patent: Mar. 18, 2014

(54) DEVICE FOR VARIABLY ADJUSTING THE CONTROL TIMES OF GAS EXCHANGE VALVES OF AN INTERNAL COMBUSTION ENGINE

(75) Inventor: Jurgen Weber, Erlangen (DE)

(73) Assignee: Schaeffler Technologies GmbH & Co. KG, Herzogenaurach (DE)

( * ) Notice: Subject to any disclaimer, the term of this patent is extended or adjusted under 35 U.S.C. 154(b) by 8 days.

(21) Appl. No.: 13/580,476

(22) PCT Filed: Jan. 25, 2011

(86) PCT No.: PCT/EP2011/050972

§ 371 (c)(1),
(2), (4) Date: Aug. 22, 2012

(87) PCT Pub. No.: WO2011/104055

PCT Pub. Date: Sep. 1, 2011

(65) Prior Publication Data

US 2012/0318222 A1 Dec. 20, 2012

(30) Foreign Application Priority Data

Feb. 26, 2010 (DE) ..... 10 2010 009 394

(51) Int. Cl.
*F01L 1/34* (2006.01)

(52) U.S. Cl.
USPC ..... 123/90.17; 123/90.15

(58) Field of Classification Search
USPC ..... 123/90.15, 90.17, 90.31
See application file for complete search history.

(56) References Cited

U.S. PATENT DOCUMENTS

| | | | | |
|---|---|---|---|---|
| 5,095,857 | A | 3/1992 | Hampton et al. | |
| 6,619,248 | B1 * | 9/2003 | Bertelshofer et al. | 123/90.15 |

FOREIGN PATENT DOCUMENTS

| | | |
|---|---|---|
| DE | 10007200 | 8/2001 |
| DE | 19708661 | 6/2005 |
| DE | 102005024241 | 12/2006 |
| DE | 102006036052 | 2/2008 |
| DE | 102008017688 | 10/2009 |
| WO | 0161154 | 8/2001 |
| WO | 03085238 | 10/2003 |
| WO | 2007082600 | 7/2007 |

* cited by examiner

*Primary Examiner* — Zelalem Eshete
(74) *Attorney, Agent, or Firm* — Volpe and Koenig, P.C.

(57) ABSTRACT

A device (11) for variably adjusting the control times of gas exchange valves (9, 10) of an internal combustion engine (1), including a drive element (13), an output element (14), and at least one lateral cover (15). The drive element (13) can be brought into driving connection with a crankshaft (2) of the internal combustion engine (1), and the output element (14) can be brought into driving connection with a camshaft (6, 7) of the internal combustion engine (1) and is arranged in a pivotable manner with respect to the drive element (13). The lateral cover (14) lies on an axial lateral surface of the output element (14) or of the drive element (13) and is connected to the drive element (13) or to the output element (14) in a rotationally fixed manner. A spring element (25) lies on the lateral cover face that faces away from the drive and output element (13, 14), and the lateral cover (15) has a disk-shaped portion (23) from which multiple fixing elements (24) protrude in the axial direction, said elements lying on the lateral cover (15) face that faces away from the drive element (13).

8 Claims, 3 Drawing Sheets

DEVICE FOR VARIABLY ADJUSTING THE CONTROL TIMES OF GAS EXCHANGE VALVES OF AN INTERNAL COMBUSTION ENGINE

FIELD OF THE INVENTION

The invention relates to a device for variably adjusting the control times of gas exchange valves of an internal combustion engine with a drive element, a driven element, and at least one lateral cover, wherein the drive element can be brought into a driven connection with a crankshaft of the internal combustion engine, wherein the driven element can be brought into a driving connection with a camshaft of the internal combustion engine and is arranged so that it can pivot relative to the drive element, wherein the lateral cover is arranged on an axial lateral face of the driven element or the drive element and is locked in rotation with the drive element or the driven element, wherein a spring element is arranged on the side of the lateral cover facing away from the drive and the driven elements, and wherein the lateral cover has a disk-shaped section from which several attachment elements project in the axial direction that are arranged on the side of the lateral cover facing away from the drive element.

BACKGROUND

In modern internal combustion engines, devices for variably adjusting the control times of gas exchange valves are used to be able to variably adjust the phase relation between a crankshaft and a camshaft in a defined angular range between a maximum advanced position and a maximum retarded position. The device is integrated in a drive train by which torque is transmitted from the crankshaft to the camshaft. This drive train can be realized, for example, as a belt, chain, or gear drive. In addition, the device is locked in rotation with a camshaft and can have, for example, one or more pressure chambers by which the phase relation between the crankshaft and the camshaft can be selectively changed by the loading of pressurized medium.

Such a device is known, for example, from DE 10 2008 017 688 A1. The device has a drive element, a driven element, and two lateral covers, wherein the drive element is in driven connection with a crankshaft and the driven element is locked in rotation on a camshaft. Here, the driven element is arranged so that it can pivot at a defined angular interval relative to the drive element. The drive element, the driven element, and the lateral cover define several pressure chambers that form a hydraulic adjustment drive by which the phase position between the driven element and the drive element can be variably set. The lateral covers are arranged on the axial lateral faces of the driven element and the drive element and are locked in rotation with the drive element by screws. Here, the screws engage through the first lateral cover and the drive element and engage in a clamping nut that is produced separately from the lateral cover and connected captively to this cover.

From DE 197 08 661 B4, another device is known in which the clamping nuts are not rigidly connected to lateral covers.

From DE 10 2005 024 241 A1, another device is known, wherein the attachment element is constructed integrally with the lateral cover. The attachment elements are constructed as cylindrical collars that are provided with internal threading and project in the axial direction from the lateral cover.

From DE 100 07 200 A1, another device is known that has a spring element that attaches on one side to the driven element and on the other side to the drive element. Here, a screw by which a lateral cover is attached to the drive element projects from the device. The spring element has a hook that is suspended in this projecting area.

SUMMARY

The present invention is based on the objective of offering a device with increased service life and reliability.

The objective is met according to the invention in that the disk-shaped section has, on the lateral face facing the spring element, a bulge that is opposite at least one spring winding of the spring element in the axial direction of the device.

The device has a drive element and a driven element, wherein the drive element is driven by a crankshaft of the internal combustion engine and the driven element drives a camshaft of the internal combustion engine. The drive element can be in driven connection with the crankshaft, for example, via a traction mechanism or gear drive. The driven element can be locked in rotation, for example, with the camshaft. In addition, an adjustment drive is provided, for example, a hydraulic adjustment drive with at least two pressure chambers acting opposite each other and by which the driven element can be pivoted in a defined angular range relative to the drive element. Thus, a phase relation between the driven element and the drive element can be variably adjusted. A lateral cover is provided on an axial lateral face of the drive element and/or the driven element. This lateral cover is locked in rotation with one of these components. Here, the lateral cover has a disk-shaped section that optionally has a central opening and seals, for example, the pressure chambers in the axial direction. Attachment elements project in the axial direction from the axial lateral face of the lateral cover facing away from the driven element or the drive element. These can involve, for example, screw heads of screws or clamping nuts in which the screws engage. By use of the attachment elements, the connection between the lateral cover and the driven element or the drive element can be established. In the case of clamping nuts, these can be connected rigidly to the disk-shaped section before installation of the side cover or can be present as separate components. Also conceivable are embodiments in which the attachment elements are constructed integrally with the disk-shaped section, for example, as cylindrical collars that are provided with internal threading.

A spring element constructed, for example, as a helical spring, in particular, as a spiral spring, is provided in front of the disk-shaped section and attaches to the driven element on one side and to the drive element on the other side. Through the use of the spring element, the driven element is loaded relative to the drive element with a torque that can be used, for example, for compensating friction losses or for achieving a base position in the event of insufficient loading by the pressurized medium.

If the spring element is excited into axial oscillations when the internal combustion engine is operating, then there is the risk that the spring element or a winding of the spring element enters into the area between the attachment elements or becomes jammed in this area, which would deactivate the function of the spring element or damage the spring element.

To prevent this, the disk-shaped section has, on the lateral face facing the spring element, at least one bulge that is opposite at least one spring winding of the spring element in the axial direction of the device. The bulge is used as a stop for the spring element. If the spring element is excited into axial oscillations, then this meets the spacing element, wherein the oscillation amplitudes are reduced. Thus, the oscillation loads acting on the spring element decrease. In addition, the oscillations are damped. The stiffness of the disk-shaped section is also increased by these bulges.

Advantageously, the extent of the bulge in the radial direction of the disk-shaped section is such that each spring winding of the spring element is opposite the bulge in the axial direction and thus each spring winding undergoes the desired damping.

It can also be provided that the bulge limits an axial movement of the spring winding such that this cannot enter into an area within the attachment elements in the radial direction. In this way the possibility that the spring winding becomes jammed between the attachment elements, and thus the function of the spring element is deactivated or the spring element is damaged, is prevented.

In one advantageous improvement of the invention it can be provided that the bulge is constructed integrally with the disk-shaped section.

It is conceivable, for example, that the disk-shaped section on the side facing away from the spring element has a recess in the area of the bulge. The bulge thus has a groove-like shape in the disk-shaped section.

In this case it can be provided that the device has pressure chambers that are separated by vanes and projections, the recess is arranged in the area of the pressure chambers, vanes, and projections, and components from the group of vanes and projections can be pivoted relative to the recess, wherein the recess is arranged outside of the pivoting range of the pivoting components. This effectively stops a short circuit between two adjacent pressure chambers via the recess. Here it can be provided that there are several groove-shaped bulges whose recesses communicate, on one side, with a pressurized medium line and, on the other side, with a pressure chamber. Thus, the recesses can be used for supplying pressurized medium to the pressure chambers.

If pressurized medium is applied to the recesses, this produces the additional advantage that lubricating medium is fed to the surfaces moving opposite each other when the disk-shaped section makes a rotating movement relative to the driven element or the drive element.

The recess can also be constructed as a crank of a locking mechanism in which a locking element engages in order to establish a detachable, mechanical locking between the drive element and the driven element.

Alternatively, an insert part could be provided in the recess, in order to prevent hydraulic short circuits between the pressure chambers. The insert part can be constructed as a sliding element.

As an alternative to the groove-shaped formation of the bulge, embodiments are conceivable in which the bulge is constructed solidly, i.e., as material excess on the side of the disk-shaped section facing the spring element. This can be constructed integrally with the disk-shaped section or separately from this section and attached to this section with a positive-fit, non-positive-fit, or material-fit connection.

Advantageously, the bulge projects past the attachment elements in the axial direction at least in some regions or ends flush with these elements.

The first lateral cover can be produced, for example, by non-cutting shaping methods, for example, a deep-drawing method, by a sintering method, by a metal or plastic injection molding method, or by casting, forging, or punch stamping. The bulges can be provided with friction-reducing layers or corrosion-protective layers or covered with a coating of a lubricating or protective material.

BRIEF DESCRIPTION OF THE DRAWINGS

Additional features of the invention are given from the following description and from the drawings in which an embodiment of the invention is shown in a simplified manner. Shown are.

DETAILED DESCRIPTION OF THE PREFERRED EMBODIMENTS

Figure 1:
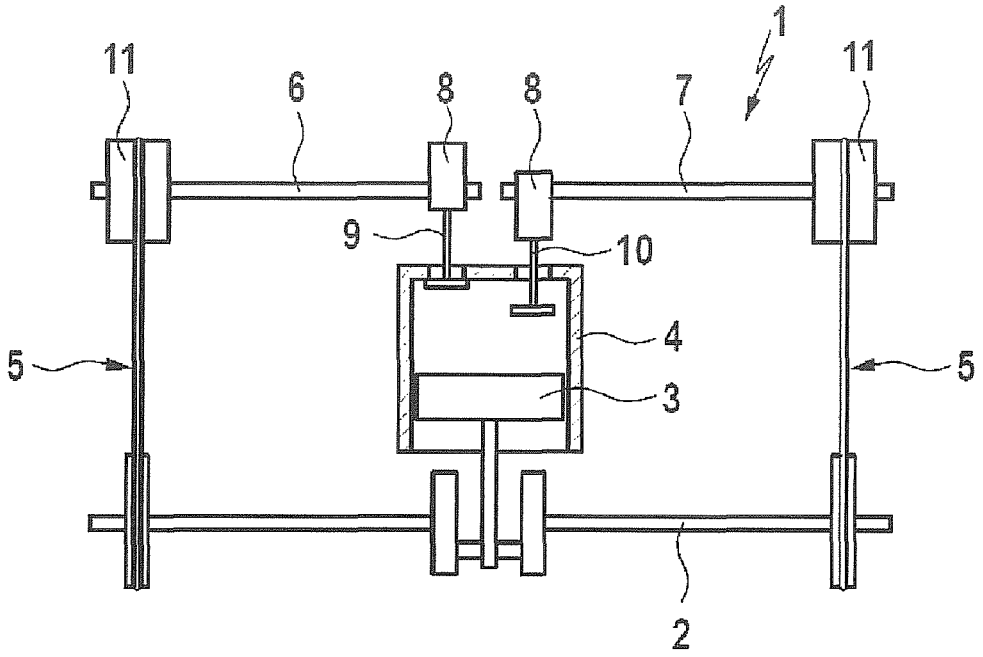
FIG. 1 only very schematically, an internal combustion engine.

In FIG. 1, an internal combustion engine 1 is sketched, wherein a piston 3 sitting on a crankshaft 2 is shown in a cylinder 4. In the illustrated embodiment, the crankshaft 2 connects to an intake camshaft 6 or exhaust camshaft 7 by a traction mechanism drive 5, wherein a first and a second device 11 for variably adjusting the control times of gas exchange valves 9, 10 can provide for a relative rotation between the crankshaft 2 and the camshafts 6, 7. The cams 8 of the camshafts 6, 7 activate one or more intake gas exchange valves 9 or one or more exhaust gas exchange valves 10.

Figure 3:
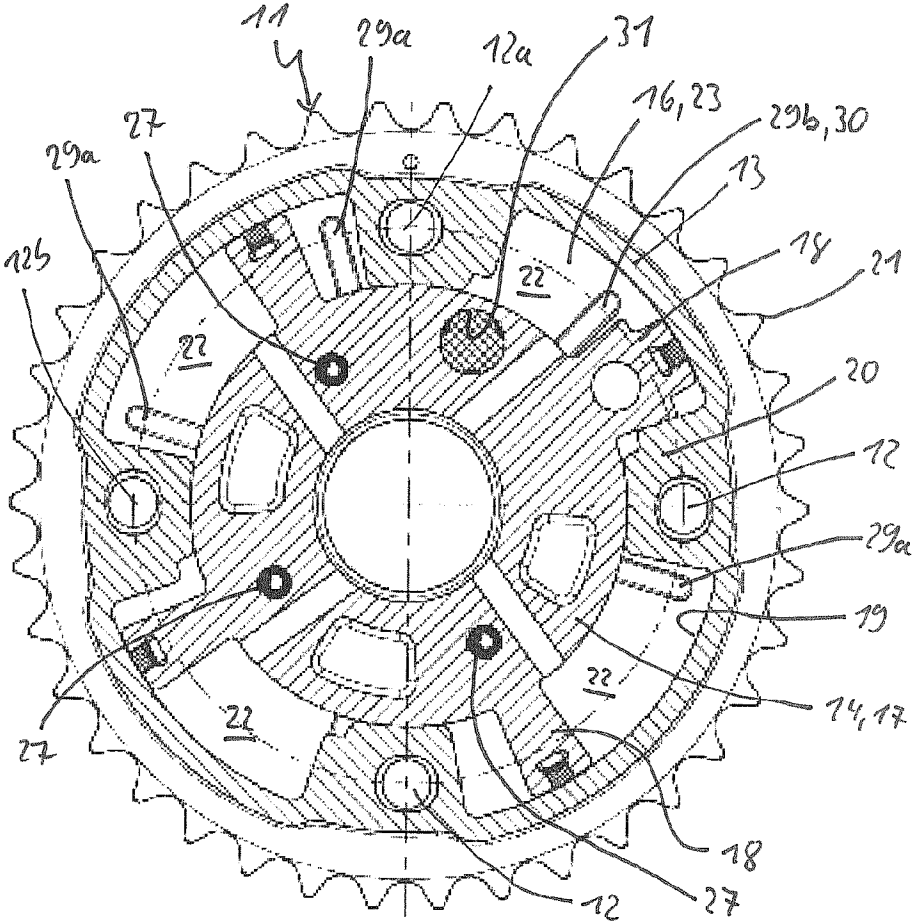
Figure 2:
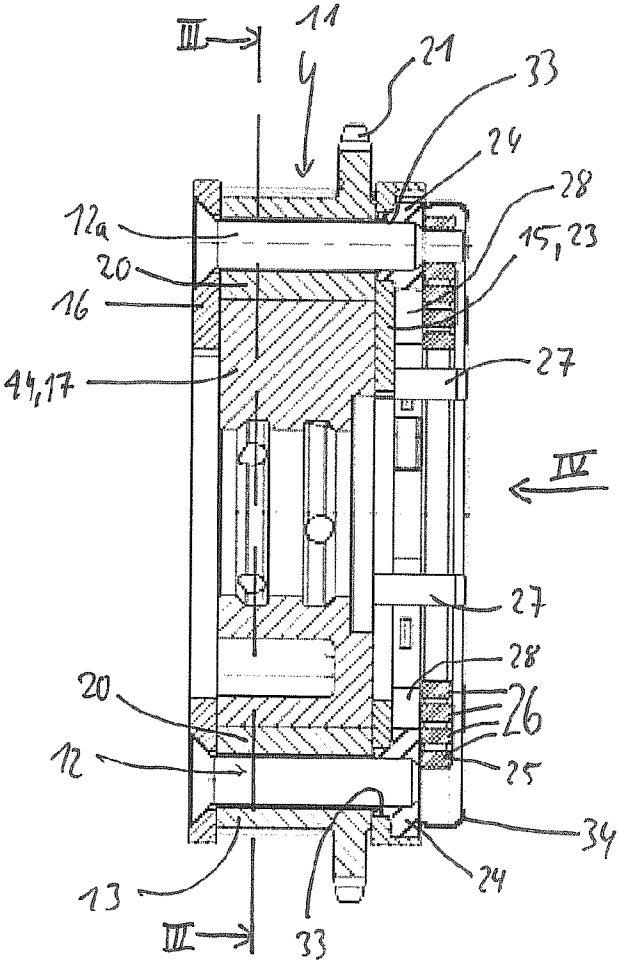
FIG. 2 a longitudinal section through a device according to the invention for variably adjusting the control times of gas exchange valves of an internal combustion engine, FIG. 3 a cross section through the device according to the invention along the line III-III in FIG. 2, FIG. 4 a top view of the device along the arrow IV in FIG. 2, FIG. 5 an view according to FIG. 4, wherein a spring cover is not shown.

FIGS. 2 and 3 show a device 11 according to the invention in a longitudinal and transverse section, respectively. The device 11 has a drive element 13, a driven element 14, and two lateral covers 15, 16 that are arranged on axial lateral faces of the drive element 13 and are attached to this element via screws 12. The driven element 14 is constructed in the form of a vane wheel and has an essentially cylindrical hub element 17 from whose outer cylindrical lateral surface vanes 18 extend outward in the radial direction.

Starting from an outer peripheral wall 19 of the drive element 13, projections 20 extend inward in the radial direction. In the illustrated embodiment, the projections 20 are constructed integrally with the peripheral wall 19. The drive element 13 is supported on the driven element by radial inner peripheral walls of the projections 20 so that it can rotate relative to this driven element 14.

The drive element 13 is provided with a chain wheel 21 by which torque can be transmitted from the crankshaft 2 to the drive element 13 via a not shown chain drive. The driven element 14 is locked in rotation in the installed state with the camshaft not shown in these figures.

A pressure space 22 is constructed within the device 11 between every two adjacent projections 20 in the peripheral direction. Each of the pressure spaces 22 is limited in the peripheral direction by adjacent projections 20, in the axial direction by the lateral covers 15, 16, in the inward radial direction by the hub element 17, and in the outward radial direction by the peripheral wall 19. A vane 18 projects into each of the pressure spaces 22, wherein the vanes 18 contact both the lateral covers 15, 16 and also the peripheral wall 19. Each vane 18 thus divides the pressure space 22 into two pressure chambers acting against each other.

By pressurizing one group of pressure chambers and depressurizing the other group, the phase position of the drive element 13 relative to the driven element 14 and thus the phase position of the camshaft 6, 7 relative to the crankshaft 2 can be varied. By pressurizing both groups of pressure chambers, the phase position can be held constant.

Figure 5:
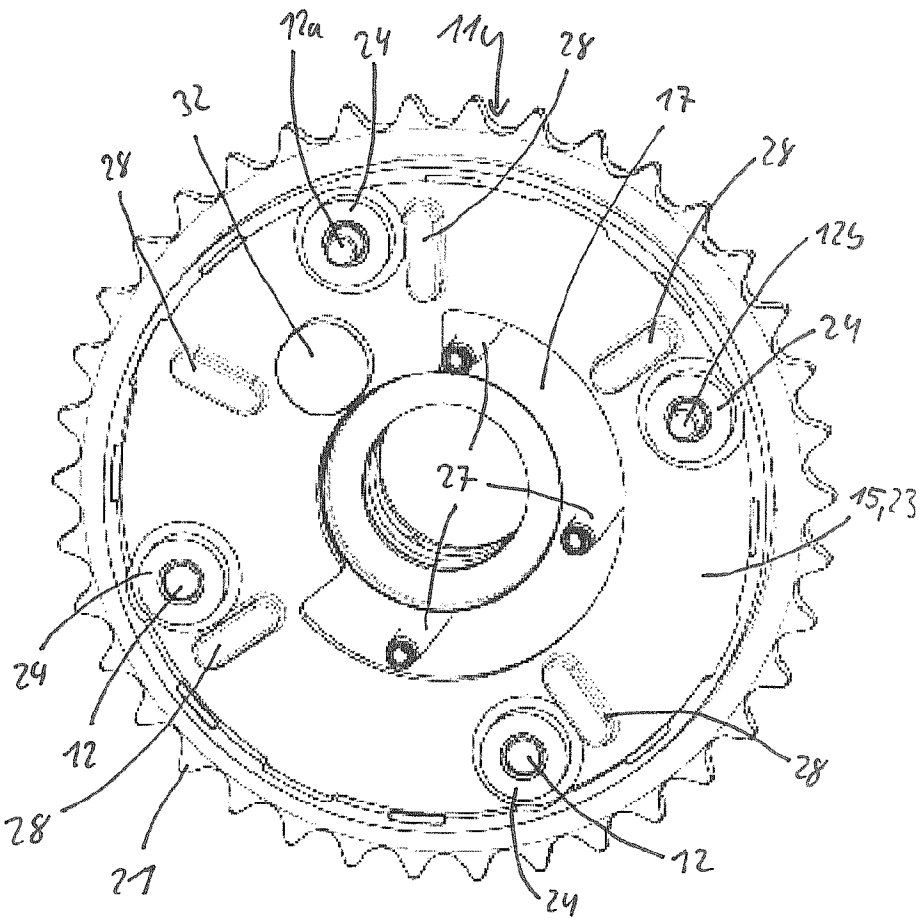
Figure 4:
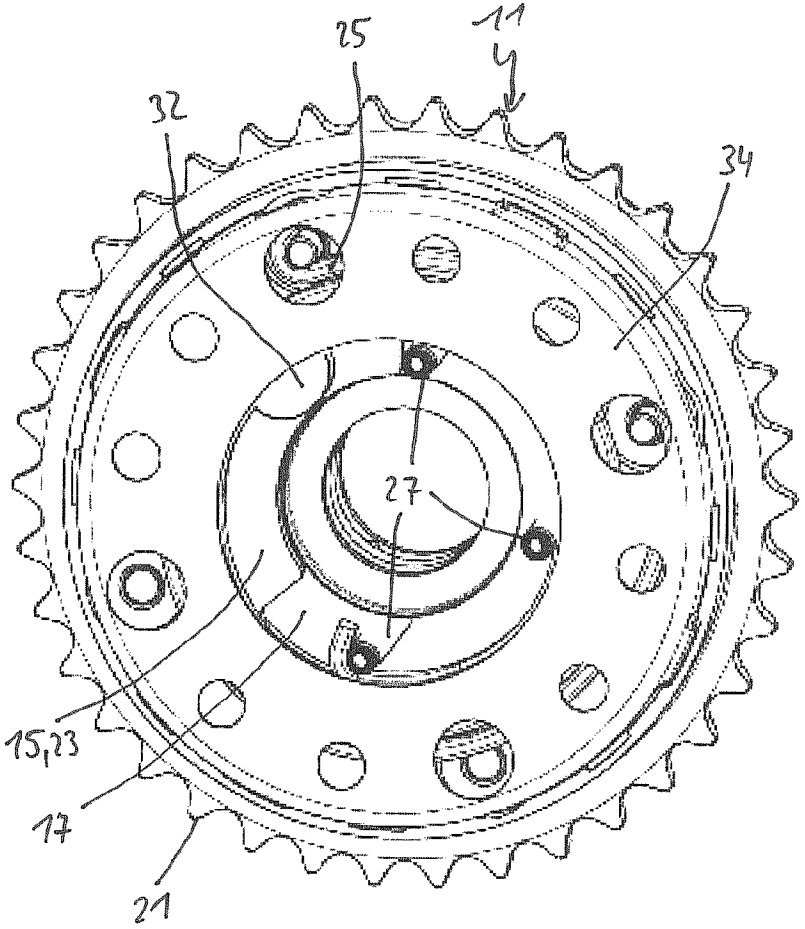

FIGS. 4 and 5 show a top view of the device 11 along the arrow IV from FIG. 2, wherein in FIG. 5 a spring cover 34 is not shown. The lateral cover 15 has a disk-shaped section 23 and four attachment elements 24 and is made from a steel plate. The attachment elements 24 are constructed in the form of clamping nuts that are attached with a positive-fit connection in openings 33 of the disk-shaped section 23. Here, the clamping nuts 24 project in the axial direction from the lateral face of the disk-shaped section 23 facing away from the drive element 13. The clamping nuts 24 are each provided with internal threading in which the screws 12 engage such that the rotationally locked connection between the lateral covers 15, 16 and the drive element 13 is produced. Here, two of the four screws 12 project in the axial direction from the clamping nut 24. The length of the other screws 12 is selected such that these do not project from the clamping nuts 24 in the installed state.

A pre-tensioned spring element 25 (FIGS. 2 and 4) in the form of a spiral spring is positioned in front of the clamping nuts 24. The spiral spring is surrounded by a spring cover 34 and has several concentric spring windings 26 of different diameters. Here, one end of the outermost spring winding 26 engages on the area of the first screw 12*a* projecting from the clamping nut 24 (FIG. 3). In its further profile, the outermost spring winding 26 is supported in the radial direction by the area of the second screw 12*b* projecting from the clamping nut 24. One end of the innermost spring winding 26 engages a pin 27 projecting from the driven element 14. At the same time, the innermost spring winding 26 is supported in the inward radial direction on two other pins 27 projecting from the driven element 14. Thus, the pretensioned spring element 25 is connected both to the drive element 13 and also to the driven element 14 such that a torque is imparted between these components. This can be used to adjust the driven element 14 in the event of insufficient supply of pressurized medium to the device 11 in a base position or to equalize different adjustment rates in the direction of more advanced or more retarded control times of the gas exchange valves 9, 10.

When the internal combustion engine 1 is operating, the spring element 25 is excited into axial and radial oscillations, wherein individual spring windings 26 can enter into the area between the attachment elements 24. In addition to increasing the friction, there is also the risk that the engaging spring winding 26 becomes jammed between the attachment elements 24, which would limit the function of the device 11. In addition, increased wear would occur on the spring element 25 and there would be the risk that the spring element 25 would break due to the increased load.

To prevent this situation, five bulges 28 extending in the direction of the spring element 25 are provided on the disk-shaped section 23. The bulges 28 are formed by means of a non-cutting shaping method, so that recesses 29 are constructed on the side facing the driven element 14 on the first lateral cover 15. Three first recesses 29*a* are arranged in the area of pressure spaces 22 outside of a pivoting area of the corresponding vane 18. A second recess 29*b* is arranged in a pivoting area of a vane 18, wherein the extent of the recess 29*b* in the peripheral direction is selected to be smaller than the corresponding extent of the vane 18. A third recess 29*c* is arranged in the area of one of the projections 20, wherein the extent of the recess 29*c* in the peripheral direction is selected smaller than the corresponding extent of the projection 20. In this way, a hydraulic short circuit between two adjacent pressure chambers is prevented. In the second recess 29*b*, an insert element 30 is also inserted, in order to further reduce the leakage between the pressure chambers and to improve the sliding contact between the first lateral cover 15 and the driven element 14.

The bulges 28 are constructed and arranged such that each spring winding 26 is opposite each bulge 28 in the axial direction.

If the spring windings 26 of the spring element 25 are excited into axial oscillations when the internal combustion engine 1 is operating, the bulges 28 prevent the spring windings 26 from entering into the area between the clamping nuts 24. In addition, the oscillation amplitude is reduced and the oscillation is damped. Thus, damage to the spring element 25 is prevented and the load caused by the oscillations is reduced. The axial lateral faces of the bulges 28 can be provided with a friction-reducing layer, for example, a Teflon layer, or a wear protective layer.

The driven element 14 has a receptacle 31 in which a not shown, axial displaceable locking pin is held. The disk-shaped section 23 has a crank 32 on which the locking pin can engage in a certain phase position of the driven element 14 relative to the drive element 13, in order to establish a detachable, mechanical coupling between these two components. The crank 32 likewise projects from the disk-shaped section 23 and can also be used, in addition to the bulges 28, as an axial stop for the spring element 25.

REFERENCE SYMBOLS

1 Internal combustion engine
2 Crankshaft
3 Piston
4 Cylinder
5 Traction mechanism drive
6 Inlet camshaft
7 Outlet camshaft
8 Cam
9 Inlet gas exchange valve
10 Outlet gas exchange valve
11 Device
12 Screw
13 Drive element
14 Driven element
15 Lateral cover
16 Lateral cover
17 Hub element
18 Vane
19 Peripheral wall
20 Projection
21 Chain wheel
22 Pressure space
23 Disk-shaped section
24 Attachment element
25 Spring element
26 Spring winding
27 Pin
28 Bulges
29*abc* Recess
30 Insert element
31 Receptacle
32 Crank
33 Opening
34 Spring cover

The invention claimed is:

1. Device for variably adjusting control times of gas exchange valves of an internal combustion engine comprising:

a drive element, a driven element, and at least one lateral cover, the drive element can be brought into driven connection with a crankshaft of the internal combustion engine, the driven element can be brought into a driving connection with a camshaft of the internal combustion engine and is arranged for rotation relative to the drive element, the lateral cover is arranged on an axial lateral face of the driven element or the drive element and is locked in rotation with the drive element or the driven element, a spring element is arranged on a side of the lateral cover facing away from the drive and the driven element, and the lateral cover has a disk-shaped section from which several attachment elements project in an axial direction that are arranged on a side of the lateral cover facing away from the drive element, the disk-shaped section has, on a lateral face facing the spring element, at least one bulge that is opposite at least one spring winding of the spring element in an axial direction of the device.

2. Device according to claim 1, wherein the bulge limits an axial movement of the spring winding such that the spring winding cannot enter into an area within the attachment elements in a radial direction.

3. Device according to claim 1, wherein the bulge is constructed integrally with the disk-shaped section.

4. Device according to claim 1, wherein an extension of the bulge in a radial direction of the disk-shaped section is constructed such that each of a spring windings of the spring element is opposite the bulge in the axial direction.

5. Device according to claim 1, wherein the disk-shaped section has, on the side facing away from the spring element, a recess in an area of the bulge.

6. Device according to claim 5, wherein the device has pressure chambers that are separated by vanes and projections, the recess is arranged in an area of the pressure chambers, the vanes, and the projections, and components from a group of the vanes and the projections can pivot relative to the recess, wherein the recess is arranged outside of a pivoting area of the pivoting components.

7. Device according to claim 1, wherein the bulge is constructed as a material excess on the side of the disk-shaped section facing away from the spring element.

8. Device according to claim 1, wherein the bulge projects over the attachment elements in the axial direction at least in some areas or ends flush with the attachment elements.

* * * * *